United States Patent [19]

Canfield

[11] 4,068,779

[45] Jan. 17, 1978

[54] FOAMED PLASTIC COOLER AND HANDLE COMBINATION

[76] Inventor: Michael P. Canfield, 7516 Placing Road, Indianapolis, Ind. 46226

[21] Appl. No.: 636,633

[22] Filed: Dec. 1, 1975

[51] Int. Cl.[2] ..... B65D 25/28

[52] U.S. Cl. ..... 220/94 R; 16/110.5; 16/114 R; 16/114 B; 220/9 F; 224/45 R; 294/27 H; 294/31.2

[58] Field of Search ..... 220/94 R, 95, 9 F; 217/125; 16/114 R, 114 B, 110.5, 115, 116 R, 119, 120, 125, 127; 224/45 R, 45 C, 50, 52, 55, 56, 58, 26 G, 25 R, 45 R; 294/31.2, 27 H, 27 R

[56] References Cited

U.S. PATENT DOCUMENTS

| | | | |
|---|---|---|---|
| 1,047,941 | 12/1912 | Hollingsworth | 190/58 C |
| 1,282,484 | 10/1918 | Steinmetz | 220/85 K |
| 1,371,175 | 3/1921 | Langer | 217/125 |
| 1,472,166 | 10/1923 | Griffiths | 206/2 |
| 1,486,747 | 3/1924 | Hibbard | 217/125 |
| 1,678,483 | 7/1928 | Ruggiero | 220/94 R |
| 1,993,682 | 3/1935 | Reetz | 16/125 |
| 2,132,316 | 10/1938 | Newton | 16/125 |
| 2,236,681 | 4/1941 | Goldschmidt | 229/52 AL |
| 2,325,841 | 8/1943 | Faber | 220/94 R |
| 2,436,271 | 2/1948 | Simmons | 217/125 |
| 2,495,667 | 1/1950 | Vizner | 24/230 B |
| 2,613,847 | 10/1952 | Lacher | 220/94 R |
| 2,781,221 | 2/1957 | Pekora | 220/95 |
| 3,251,613 | 5/1966 | Tatsch | 220/9 F |
| 3,267,545 | 8/1966 | Eckart | 24/230 B |
| 3,312,373 | 4/1967 | Gentry | 220/9 F |
| 3,385,299 | 5/1968 | LeRoy | 24/230 B |
| 3,416,691 | 12/1968 | Piker | 220/9 F |
| 3,482,867 | 12/1969 | Allen | 220/94 R |
| 3,491,913 | 1/1970 | Giraudet et al. | 220/9 F |
| 3,670,918 | 6/1972 | Mitchell | 220/9 F |

*Primary Examiner*—William Price
*Assistant Examiner*—Allan N. Shoap
*Attorney, Agent, or Firm*—Woodard, Weikart, Emhardt & Naughton

[57] ABSTRACT

A foamed plastic cooler and handle combination comprising a foamed plastic container having an essentially upright side wall, the exterior of the side wall including a downwardly facing shoulder extending at least partially around the side wall, a frame lying adjacent the exterior of the side wall immediately below the downwardly facing shoulder and extending perimetrically around the exterior of the side wall of the container, and a flexible, continuous rope handle threaded through apertures in the frame. The container is lifted by the flexible rope, and the force required to lift the container and its contents is distributed along the downwardly facing shoulder on the exterior of the side wall of the container.

3 Claims, 4 Drawing Figures

FOAMED PLASTIC COOLER AND HANDLE COMBINATION

BACKGROUND OF THE INVENTION

1. Field of the Invention:

This invention relates to foamed plastic coolers having handles by which they are lifted.

2. Description of the Prior Art:

Foamed plastic coolers have become recognized as an inexpensive means for transporting food and other items at a reduced temperature. The coolers consist of a container and a top which fits snugly onto the container. The items are placed inside the container, usually with ice, and the foamed plastic walls of the container insulate the contents from the warmer temperature on the outside.

The problem most frequently encountered with foamed plastic coolers is that the handles by which they are carried usually are inadequate to permit a substantial amount of weight to be lifted. Even those handle apparatus which initially are capable of supporting a lot of weight will frequently fail within a short period of time.

The typical handle apparatus includes a plug which is inserted through the side wall of the container and which holds the supporting structure of the handle. There is usually either one handle having its ends connected to plugs in opposite sides of the container wall, or two handles, each being supported by plugs inserted within opposite sides of the container. The problem with this arrangement is that the force exerted in lifting the container by the handles is carried by only a small portion of the container walls, that portion surrounding and lying above the plugs. If a large amount of weight is carried within the container, the handle apparatus will frequently fail either by the plugs being pulled out of the container wall or by the container wall itself breaking apart above the plugs. When this occurs, the handle apparatus is made useless, and the insulating capabilities of the container are greatly reduced due to the holes through the container wall.

A second type of handle accommodation consists merely of recesses in the exterior of the side wall on opposite sides of the container. The recess is designed to permit a person's hand to grasp the container and to lift it in that manner. This design, as in the case of the plug apparatus, can fail when the container is carrying a substantial amount of weight. The portion of the container walls located above the recesses will deteriorate under the stress and will break away from the remainder of the container.

Another problem with these two handle designs is that they are not well suited to permit the container to be carried by two people. In the plug handle apparatus, either the handle plug or the container wall is likely to break away when the container is of a size and weight that requires it to be carried by two people. In addition, when two people are carrying the container, there is likely to be a less even distribution of the weight which is being supported by a particular plug held within the container wall. This is true because the less coordinated movement of two people will cause the weight which either person is carrying to vary as the container is transported. This in turn will cause the weight being supported by the individual plugs to similarly vary. As a result, the stresses applied through the plugs to the supporting wall portion of the container is likely to be greater than would normally be the case if the container was being carried by one person. This increases the likelihood that either the plug will be pulled from the container wall or the container wall will fail. Finally, when such a container is carried by two people, there will be increased horizontal stresses applied to the container wall through the supporting plug, and this additional stress will further increase the likelihood that the plug will be dislodged or the container wall will break apart.

Similarly, the recess handle apparatus is poorly suited to permit the cooler to be carried by two individuals. The recesses are generally not shaped to enable a person to carry only one end of the container. In addition, the varying stresses applied in carrying the cooler will increase the likelihood of failure of the container wall.

An additional disadvantage of the plug handle apparatus is the inability of the handle to be removed from one cooler and attached to another. Foamed plastic coolers are very susceptible to damage which renders them useless. The tops of the coolers are easily broken and the walls of the container frequently develop leaks. When this occurs, the cooler is thrown away; and the attached handle apparatus is accordingly disposed of before it has broken. The expense of the handle apparatus must, therefore, be incorporated into every cooler which is sold. In contrast, a transferable handle apparatus could be used through its entire useful life; and coolers could be sold at a lower price without handles attached.

SUMMARY OF THE INVENTION

A foamed plastic cooler and handle combination is disclosed herein which comprises a foamed plastic cooler having an upwardly extending side wall, the exterior of the side wall including a downwardly facing shoulder extending at least partially around the side wall, frame means connected to the cooler for engaging the downwardly facing shoulder, and handle means attached to the frame means for permitting the cooler to be lifted.

It is an object of the present invention to provide a foamed plastic cooler and handle combination in which a relatively large amount of contents can be carried by the handle.

A further object of the present invention is to provide a foamed plastic cooler and handle combination which may be easily carried by more than one person at one time. Another object of the present invention is to provide a foamed plastic cooler and handle combination which incorporates a handle apparatus which may be used on a second foamed plastic cooler when the first cooler has been damaged.

Further objects and advantages of the present invention shall be apparent from the following detailed description and accompanying figures.

DESCRIPTION OF THE PREFERRED EMBODIMENTS

Figure 1:
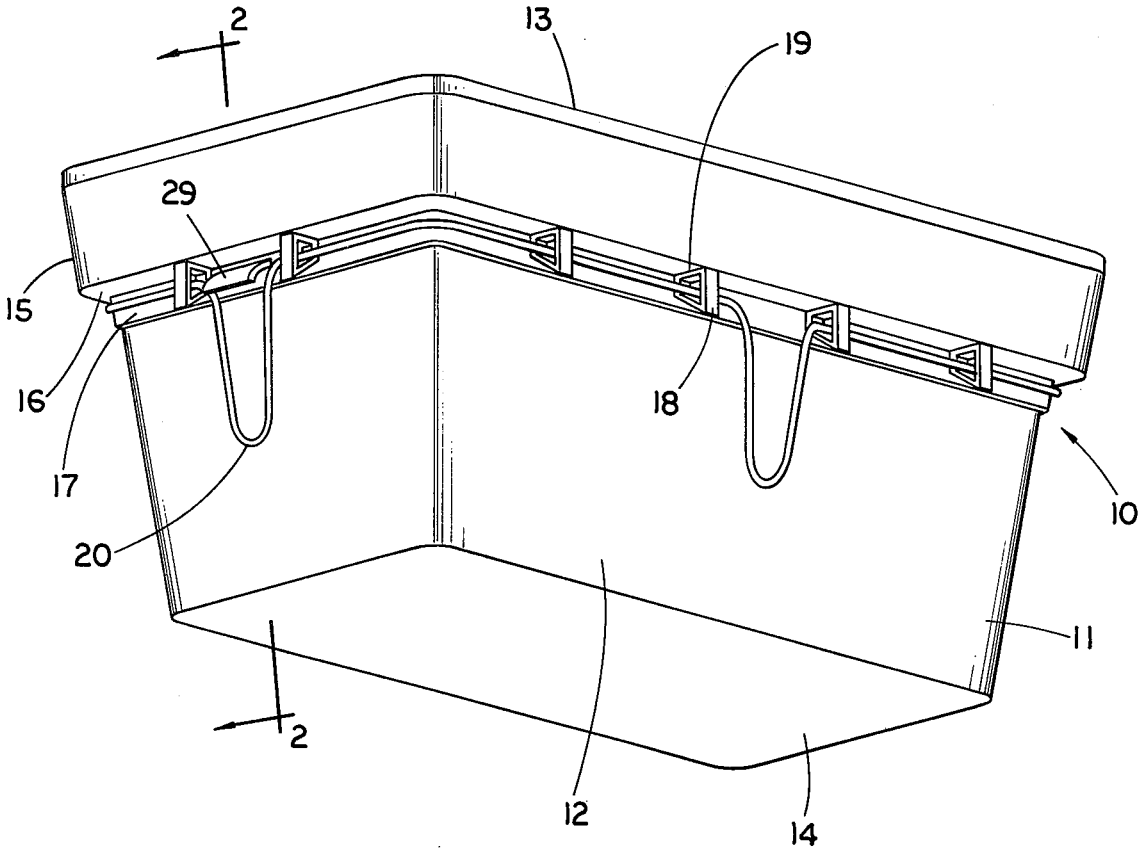
FIG. 1 is a perspective view of a cooler and handle combination according to the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring in particular to FIG. 1, there is shown a foamed plastic cooler and handle combination 10 according to the present invention. The cooler 11 comprises a container 12 and a top 13. The container 12 consists of a rectangular bottom 14 and an upwardly extending and outwardly tapering side wall 15. A downwardly facing shoulder 16 extends outwardly and perimetrically around the exterior of the side wall 15. A frame 17 extends continuously around the exterior of the side wall 15 immediately below the shoulder 16. Several loops, such as 18, are attached to the frame 17 and have an upper surface 19 which is contiguous with the shoulder 16. The continuous length of rope 20 is threaded through the apertures in the loops. Handles such as 29 are attached to frame 17 on opposite ends of cooler 11 to provide an alternate to rope 20 for carrying the cooler.

The frame 17 and the loops such as 18 should have sufficient strength to support a substantial amount of weight carried within the cooler 11. Forming the frame and loops from the plastic material generally provides sufficient strength in these members while enabling the the manufacture of the frame to be relatively simple and inexpensive. For a cooler for which a plastic frame is inadequate, the frame can be made from tubular aluminum. The apertures can then be made in the aluminum frame and the rope 20 can be threaded through the tubular frame. Any other material could be used in making the same handle loops, as required by the circumstances.

Similarly, the rope 20 can consist of any continuous, flexible material threaded through apertures associated with the frame 17. It is not necessary that the rope 20 be continuous. Rather, the cooler could be carried by any handle which may be attached to the frame. The handles could, for example, consist of ropes rather than flexible members having their ends tied or otherwise secured to the frame. The handles could also consist of some type of rigid member which is secured to the frame. The use of a flexible continuous member, however, was preferred because it permits the relative length of the handle on opposite sides of the cooler to be varied. Therefore, if two persons are carrying the cooler, one at each end, then the rope or other flexible member can be adjusted to suit the respective heights of the individuals involved.

As depicted in FIG. 1, it is preferable to have at least one pair of loops such as 18 located on each side of a rectangular container. This configuration permits the container to be carried by either grasping handle portions located along opposite ends of the container or along opposite sides of the container. The similar effect could be achieved by locating one loop on each of the four corners of the container, but that positioning would result in greater horizontal stresses being applied to the side wall 15. For round or square containers, this feature is not as significant, but will sometimes be useful.

Figure 2:
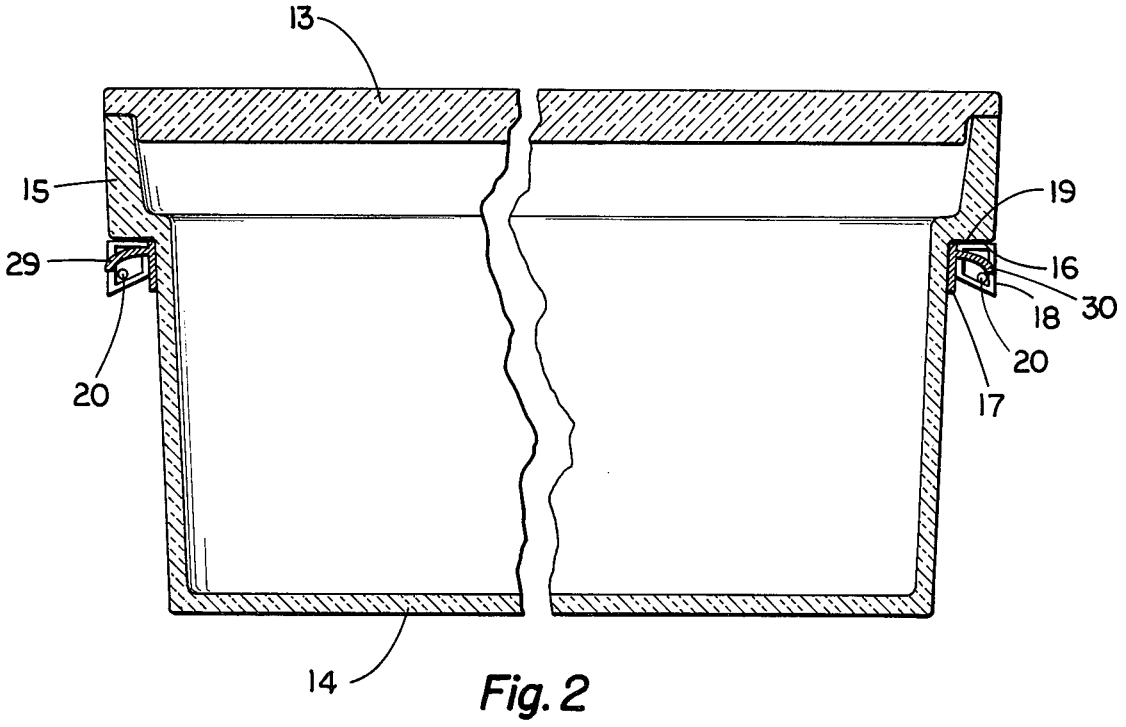
FIG. 2 is an end cross-sectional view of the embodiment pictured in FIG. 1, taken along line 2—2 in the direction of the arrows.

Pictured in FIG. 2 is a side cross-sectional view of the cooler and handle combination shown in FIG. 1. The cooler 11 includes a bottom 14, a top 13, and an upwardly extending side wall 15. The downwardly facing shoulder 16 extends outwardly and around the exterior surface of the side wall 15. The frame 17 includes several loops such as 18 through which the rope 20 is threaded.

The top of the frame 17 and the upper surface 19 of the loops such as 18 lie immediately adjacent the downwardly facing shoulder 16. When the cooler is lifted by the handle rope 20, the lifting force is transmitted to the container 12 along the length of the shoulder 16. In this manner the lifting force is distributed over a relatively large area, which is more capable of supporting the force. The force is similarly distributed when the cooler is lifted by rigid handles 29 and 30.

The frame 17 may be secured to the side wall 15 in any suitable manner. Preferably the frame is sized to snugly fit against the side wall 15 when it is positioned adjacent the downwardly facing shoulder 16. The frame 17 is then frictionally held to the side wall 15 when the container 12 is not being lifted by the rope 20. Alternatively, the frame 17 could be attached to the container by incorporating the frame into the side wall when the container is manufactured. The frame can also be attached by using an adhesive, or by incorporating into the interior surface of the frame 17 a plurality of downwardly directed barbs which would prevent the frame from moving after the frame has been positioned against the shoulder 16.

Figure 3:
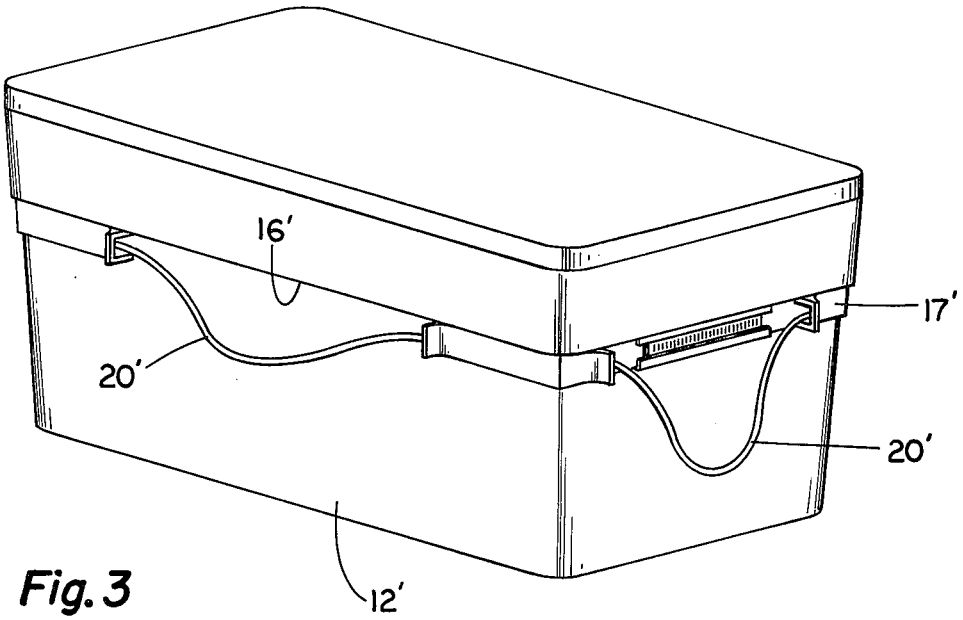
FIG. 3 is a perspective view of an alternate embodiment of the cooler and handle combination.

Referring now to FIG. 3 there is shown an alternate embodiment of the cooler and handle combination according to the present invention. The frame 17′ comprises a pair of identical, U shaped members, each of which are fitted over opposite ends of the container 12′ immediately adjacent the shoulder 16′. A continuous length of rope 20′ is threaded through apertures in the corners of frame 17′.

Figure 4:
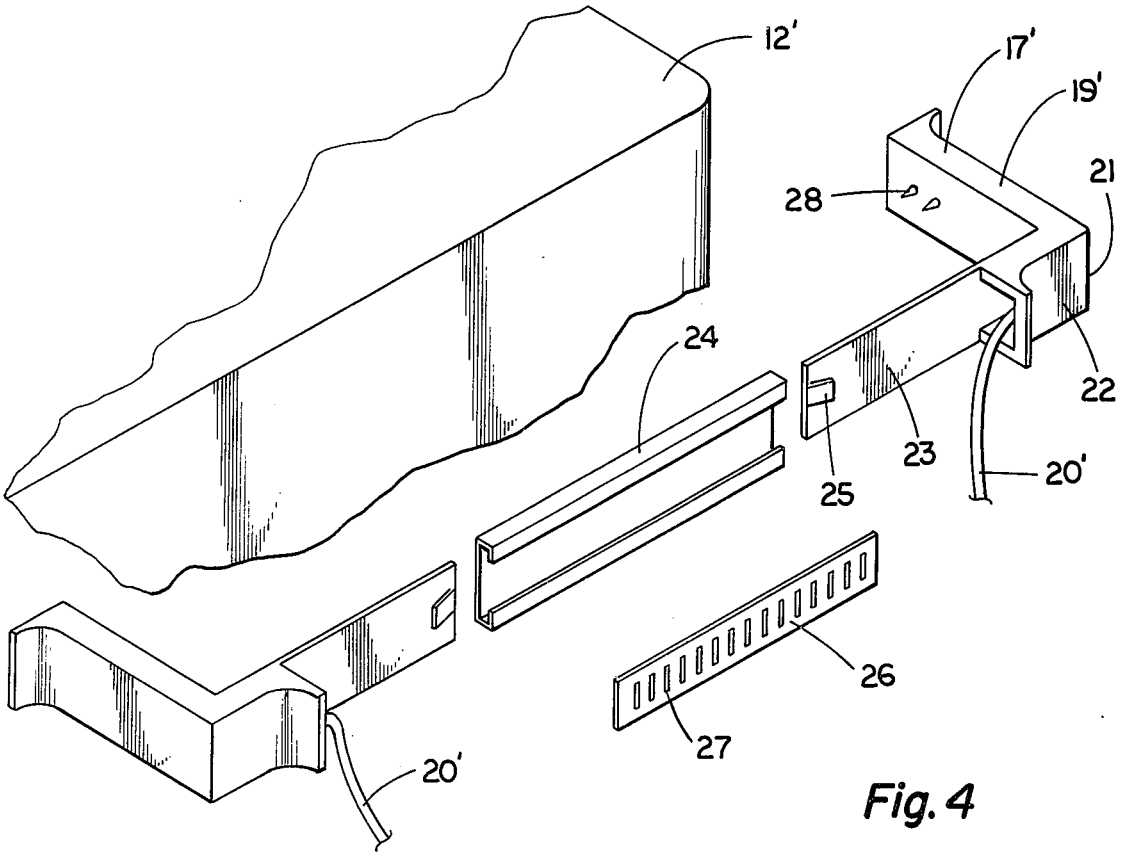
FIG. 4 is an exploded, perspective view of a portion of the cooler and handle combination shown in FIG. 3.

A perspective view of the four components of the Ushaped members appears in FIG. 4. The combination of components represents a preferred means for making the end length of the frame 17′ adjustable. By being adjustable, the frame is easily removed from a cooler which may have become damaged or otherwise made useless. The frame 17′ and rope handle 20′ can then be easily installed upon a new container. In addition, the frame and handle can be utilized on varying sizes of coolers.

The frame includes corner members such as 21 through which the rope 20′ is threaded. Corner member 21 includes a body portion 22 having an upper surface 19′ for engaging the shoulder 16′. A thin rectangular locking portion 23 extends from the body portion 22 along the side wall of the container below the downwardly facing shoulder. The locking portion 23 is received within channel member 24.

Locking portion 23 includes a tab 25 positioned by the end of the locking portion 23 and forming an acute angle therewith. The tab 25 is positioned to extend through the lengthwise slot in the channel member 24. A locking member 26 comprises a slotted rectangular member having a multitude of slots such as 27 along its length. The slots are sized to receive the tab 25 located on the locking portion 23 of the corner member 21. To install the frame 17' onto the container, the corner members such as 21 are positioned at the corners of the container with the locking portion extending into the channel member 24. The slotted locking member 26 is then positioned over the tabs such as 25 and the tabs are received within slots in the locking member.

To fully insure that the frame 17' is held in position against the downwardly facing shoulder 16', gripping elements such as 28 are incorporated into the body portions 22 of the frame 17'. The gripping elements extend inwardly from the body portion 22 towards the side wall of the container 12'. When the corner members are positioned against the corners of the container, the gripping elements become imbedded in the exterior wall of the container and prevent the frame from moving vertical relative to the container.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A foamed plastic cooler and handle combination which comprises:

a foamed plastic cooler having an upwardly extending side wall, the exterior of the side wall including a downwardly facing shoulder extending at least partially around the side wall, the side wall having a first portion lying immediately below the shoulder, the first portion comprising four flat surfaces intersecting at approximately right angles;

frame means for engaging the downwardly facing shoulder, said frame means including a pair of apertures located along each of the four flat surfaces, said frame means including a support member which extends perimetrically about the foamed plastic cooler adjacent the downwardly facing shoulder; and handle means attached to said frame means for permitting said foamed plastic cooler to be lifted, said handle means comprising a flexible member, the flexible member of said handle means being continuous in passing through each of the pair of apertures of said frame means.

2. The combination of claim 1 in which:

said frame means includes adjusting means for adjusting the perimetric length of the support member to exert pressure against the side wall of said cooler when the perimetric length is sufficiently reduced, thereby securing said support member to said cooler; and said frame means further includes a plurality of gripping elements attached to said frame means and extending inwardly toward the cooler from said frame means, the gripping elements being imbedded in the side wall of said cooler when said frame means is positioned to engage the shoulder of the side wall.

3. The combination of claim 1 in which said frame means includes adjusting means for adjusting the perimetric length of the support member to exert pressure against the side wall of said cooler when the perimetric length is sufficiently reduced, thereby securing said support member to said cooler.

* * * * *